United States Patent [19]

de Lachaux et al.

[11] 3,980,545

[45] Sept. 14, 1976

[54] BIPOLAR ELECTRODES WITH INCORPORATED FRAMES

[75] Inventors: Hubert de Lachaux, Courevoie; Pierre Bouy, Enghien-les-Bains; Michel Conan, Rueil-Malmaison, all of France

[73] Assignee: Rhone-Progil, Courbevoie, France

[22] Filed: June 12, 1974

[21] Appl. No.: 478,605

[30] Foreign Application Priority Data

July 6, 1973 France ..... 73.25917

[52] U.S. Cl. ..... 204/286; 204/254; 204/268

[51] Int. Cl.[2] ..... C25B 9/00; C25B 11/00; C25B 1/26

[58] Field of Search ..... 204/254–256, 204/268, 286, 288, 289

[56] References Cited

UNITED STATES PATENTS

| | | | |
|---|---|---|---|
| 3,674,676 | 7/1972 | Fogelman | 204/286 |
| 3,755,105 | 8/1973 | Messner | 204/95 |
| 3,755,108 | 8/1973 | Raetzsch et al. | 204/98 |
| 3,770,611 | 11/1973 | Barnabe | 204/256 |
| 3,824,173 | 7/1974 | Bouy et al. | 204/284 |
| 3,836,448 | 9/1974 | Bouy et al. | 204/270 |
| 3,839,179 | 10/1974 | Koziol et al. | 204/219 |
| 3,859,197 | 1/1975 | Bouy et al. | 204/284 |

FOREIGN PATENTS OR APPLICATIONS

| | | |
|---|---|---|
| 2,153,399 | 5/1973 | France |

*Primary Examiner*—F.C. Edmundson

[57] ABSTRACT

Bipolar electrodes are provided for electrolysis cells of the filter-press type with incorporated cathode and/or anode frames. These frames are integrated in the bimetallic base plate of the electrode serving as reference plane, perpendicularity with respect to said plane being assured with respect to the cathode and anode portions by the current leads to which they are welded, these current leads serving as stiffeners and resulting in the planarity of these electrode portions and their parallelism with respect to the reference plane formed by the bimetallic base plate.

These electrodes are highly efficient in the electrolysis of alkaline chlorides.

8 Claims, 9 Drawing Figures

BIPOLAR ELECTRODES WITH INCORPORATED FRAMES

BACKGROUND OF THE INVENTION

The present invention concerns bipolar electrodes for electrolysis cells of the filter-press type, in which the cathode and/or anode frames have been incorporated.

Bipolar electrodes are known to have the advantage of permitting compact construction in electrolysis cells and an ease of feeding of electricity due to the electrical connection in series of the unit cells formed by the succession of electrodes. These electrodes are characterized by the fact that their two active portions are separated in space, and by a careful assembling of these two portions which permits the passage of electricity of high density with very low ohmic or resistance losses.

While the general characteristics of cells of the filter-press type have been known for a long time, the materials used heretofore for the construction of the electrodes, joints, frames or diaphragms did not make it possible to obtain reliable operation of such cells.

In recent years, the reliability of these complex assemblies and the electrical charge per unit of surface of electrode have been improved by the use as electrodes of metal structures the construction of which include titanium and homologous metals, such as the film-forming metals, the anode portions of these structures being covered with conductive active layers having a base of noble metals or oxides of said metals, which are not attacked by the electrolyte.

Such bipolar electrodes have been described in particular in Copending Buoy et al. U.S. patent application, entitled "Bipolar Electrodes," filed on Dec. 13, 1972, under Ser. No. 314,728, now U.S. Pat. No. 3,859,197. The anode portion consists of titanium covered with a conductive active layer and the cathode portion is of mild steel. These electrodes are characterized by the fact that these two portions are separated in space, at least one of them being perforated, and by the fact that the electrical connection between these two portions is effected via the contact formed by the cladding of the titanium on the mild steel. The mechanical connection between these two active portions and the mixed parts thus formed by cladding is obtained by plates or shaped parts of titanium and of plates of mild steel.

However, the construction of filter-press cells of high productivity employing these electrodes raises difficult problems of gas-liquid separation and of flow of the electrolyte. In order to avoid the possible disadvantages, copending Buoy et al. U.S. patent application, entitled "Frames for Electrolytic Cells of the Filter-Press Type," filed on Dec. 13, 1972, under Ser. No. 314,817, now U.S. Pat. No. 3,836,448 discloses frames consisting of two distinct zones, a low zone contemplated to receive an anode or a cathode and a high zone in the form of a closed box contemplated to assure the separation of the electrolyte and the gases produced during the electrolysis.

The use of electrolytically active portions, at least one of which is provided with holes or perforations, requires the presence of a partition between these two portions in order to avoid attack of the electrolytically active portions or avoid the mixing of the anolyte with the catholyte. Such a partition can be formed of a metal wall which may have two faces of different materials which, however, are not attacked by the electrolyte with which each of them is in contact.

The two portions being separated in space, it is necessary to assure good rigidity and good planarity of the assembly, in particular as the interpolar distance between successive electrodes must be constant and reduce to the minimum, so as to make possible the use of a prefabricated diaphragm.

GENERAL STATEMENT OF THE INVENTION

It is an object of the present invention to provide arrangement for constructing the bipolar electrode which makes it possible to obtain the desired rigidity and planarity.

It is an object of the invention to provide bipolar electrodes for use in electrolysis cells of the filter-press type, which electrodes avoid the disadvantages of the prior art.

Further objects will be aparent to those skilled in the art from the present description, when taken in conjunction with the appended drawings, in which.

Figure 2:
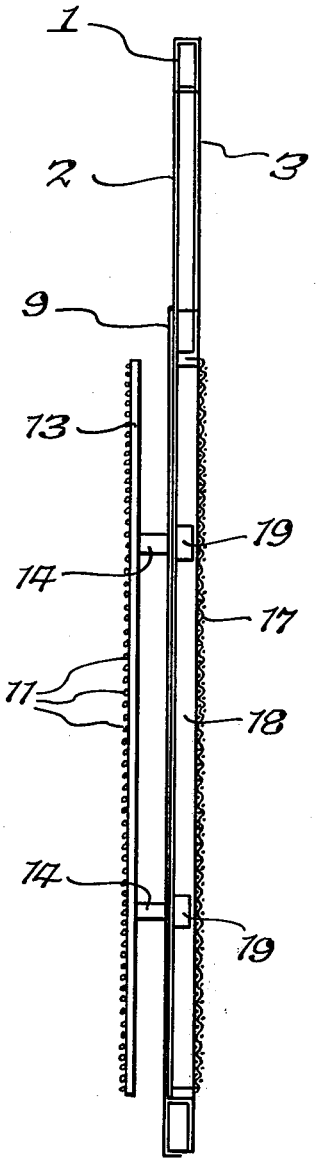
FIG. 2 is a sectional view through the electrode of FIG. 1 taken along the line A—A.
Figure 1:
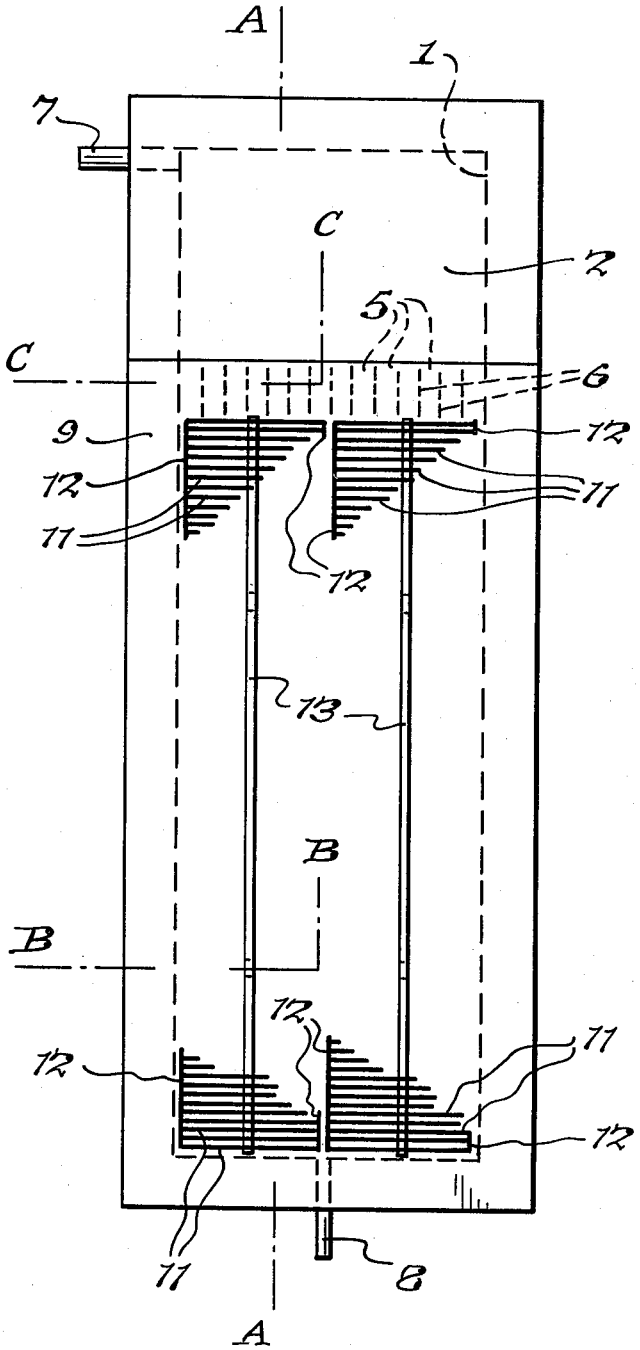
FIG. 1 is an exterior view of an electrode of the present invention.

The arrangement of the electrodes of the invention consists in effecting the integrating of the cathode and/or anode frames with the bimetallic base plate of the electrode, which plate serves as reference plane, the perpendicularity with respect to said plane being assured with respect to the cathode and anode portions by the current leads to which they are welded, which act as stiffeners and bring about the planarity of these electrode portions and their parallelism with respect to the reference plane.

This arrangement thus makes it possible on the one hand to assure the passage of the current through the bipolar electrodes and on the other hand to obtain an overall rigidity of the assembly so as to maintain a constant interpolar distance.

As in the above-mentioned copending patent applications, the anode surface is formed of titanium wires covered with precious metal connected together at their end to avoid their deformation, and the cathode surface is formed of perforated sheets or iron netting.

The anode surface is positioned solely by the current leads passing through the bimetallic base plate of the electrode.

The cathode surface is fastened on the one hand to these current leads and on the other hand to the cathode frame.

The boxes provided to assure the gas-electrolyte separation or devesiculation can be attached or integrated.

The assembly consisting of all of these parts is clamped in a frame at the ends of which the current leads arrive.

DETAILED DESCRIPTION OF THE INVENTION

In order to disclose more clearly the nature of the present invention, the following examples illustrating the invention are given. It should be understood, however, that this is done solely by way of example and is intended neither to delineate the scope of the invention nor limit the ambit of the appended claims.

EXAMPLE 1

Bipolar Electrode With Incorporated Cathode Frame

Such an electrode is shown diagrammatically in FIGS. 1 to 4 of the present application and these figures will be used in the description which follows.

The incorporated cathode frame consists of a framework in the form of a rectangular tube 1 of mild steel and of a sheet of mild steel 2 which is folded and welded onto the framework of rectangular tube 1, defining the cathode compartment. The upper zone thereof, where the gas-catholyte separation takes place, is closed off by a mild steel sheet 3. This upper zone is connected to the lower zone by a plurality of orifices 5. In the upper portion of the upper zone of the frame, a tubule 7 permits the evacuation of the gas produced at the cathode. In the lower portion of the lower zone of the frame, a tubule 8 permits the emergence of the caustic solution.

The anode face of the lower zone of the frame must be protected by a metal having anode passivation. For this there is used a sheet of titanium 9 or other film-forming metal, which is preferably fastened to the periphery of the framework 1 by screws 10, since titanium is difficult to weld to mild steel.

The combination of the mild steel sheet 2 and the titanium sheet 9 constitutes the bimetallic base plate of the electrode which serves as reference plane. The small plates of mild steel 6 assure the rigidity and planarity of the joint plane in the zone separating the lower portion from the upper portion.

On the foregoing bimetallic base plate of the bipolar electrode there are then fastened the two electrolytically active portions of the electrode, namely, the anodically-active portion and the cathodically-active portion.

The anodically-active portion is formed of wires 11 of titanium or other film-forming metals, which are connected together at their ends by titanium straps 12 in order to avoid their deformation. The resulting grid formed of the titanium wires 11 and straps 12 is welded along its central line on a co-extruded rod of copper and titanium 13. The length of the co-extruded rod determines the maximum height of the anodically active surface. The number of co-extruded rods mounted parallel to each other determines the maximum width of the anodically active surface. This anodically active surface must be covered by a non-attackable conductive layer formed, for instance, of a precious metal of the platinum group.

The cathodically active portion is formed of netting or perforated or expanded sheet of mild steel 17.

The passage of the electrical current between the anodically active and cathodically active surfaces takes place on the anode side via the assemblies 14 formed of copper plates 15 which pass through the bimetallic base plate formed of the sheets 2 and 9. These copper plates are brazed on the one hand to the co-extruded rod 13 which has been previously spot-faced to bare the copper, and on the other hand to the mild steel sheet 2. In order to protect these copper plates from the very corrosive anolyte, a covering of titanium or other film forming metal 16 has been previously welded tightly on the anode side to the copper-titanium co-extruded rod 13 and on the side of the base plate to the titanium sheet 9.

Figure 3:
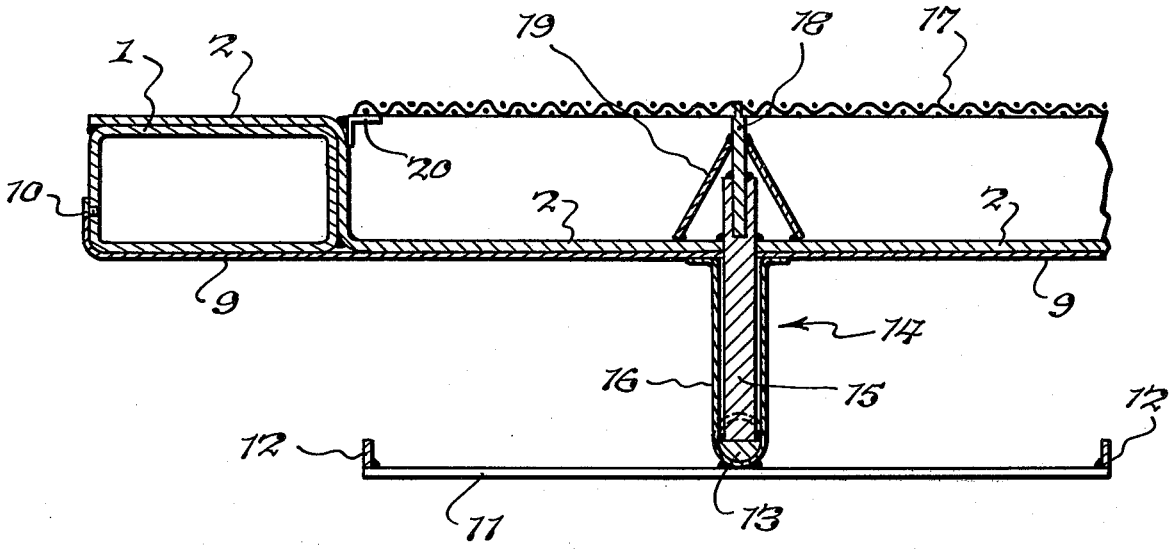
FIG. 3 is a partial sectional view of the electrode of FIG. 1, taken along the line B—B, in the direction of the width of the electrode, in its lower zone.
Figure 4:
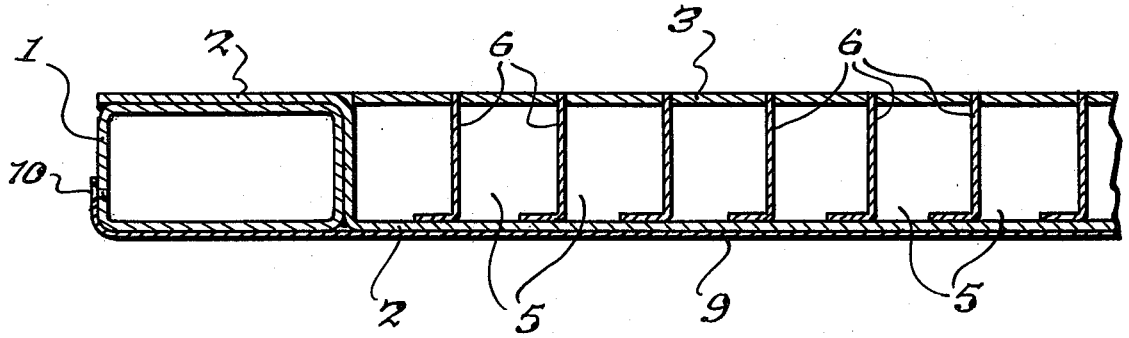
FIG. 4 is another partial sectional view of the electrode of FIG. 1, taken along the line C—C, in the direction of its width in the upper zone, where provision is made for gas-electrolyte separation or devesiculation.

On the cathode side, the electrical connection to the anode portion is effected via a steel plate 18 brazed to the copper plates 15 which pass through the bimetallic base plate. Before welding the mild steel netting 17 to this plate 18 which serves as current distributor, the ends of the copper plates 15 extending into the cathode compartment are protected by mild steel masks 19 welded onto the steel plate 18, as shown in FIG. 3.

In order to obtain a very flat cathodically active surface which is to receive a diaphragm in the case of the electrolysis of alkaline chlorides, the cathode netting 17 is held on the periphery of the frame by small angles of mild steel sheet 20.

EXAMPLE 2

Figure 5:
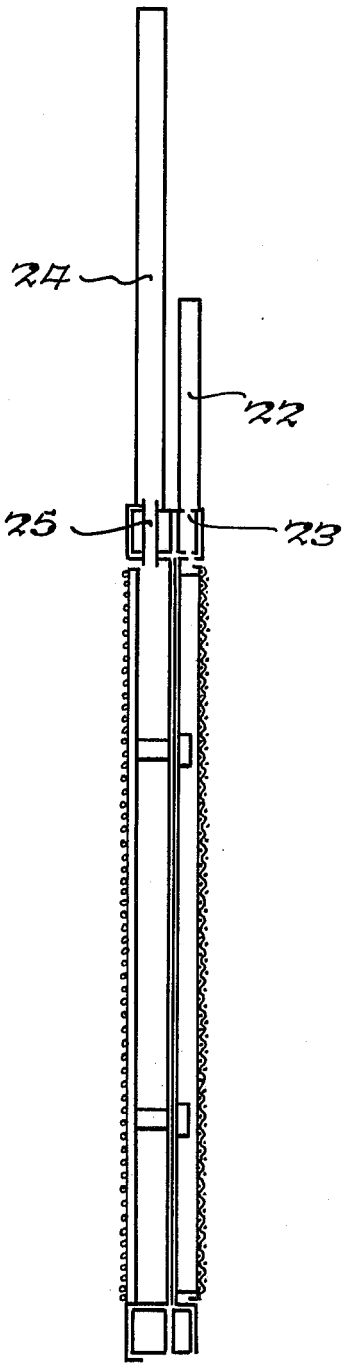
FIG. 5 is a vertical sectional view of an embodiment of an electrode in accordance with the present invention.
Figure 6:
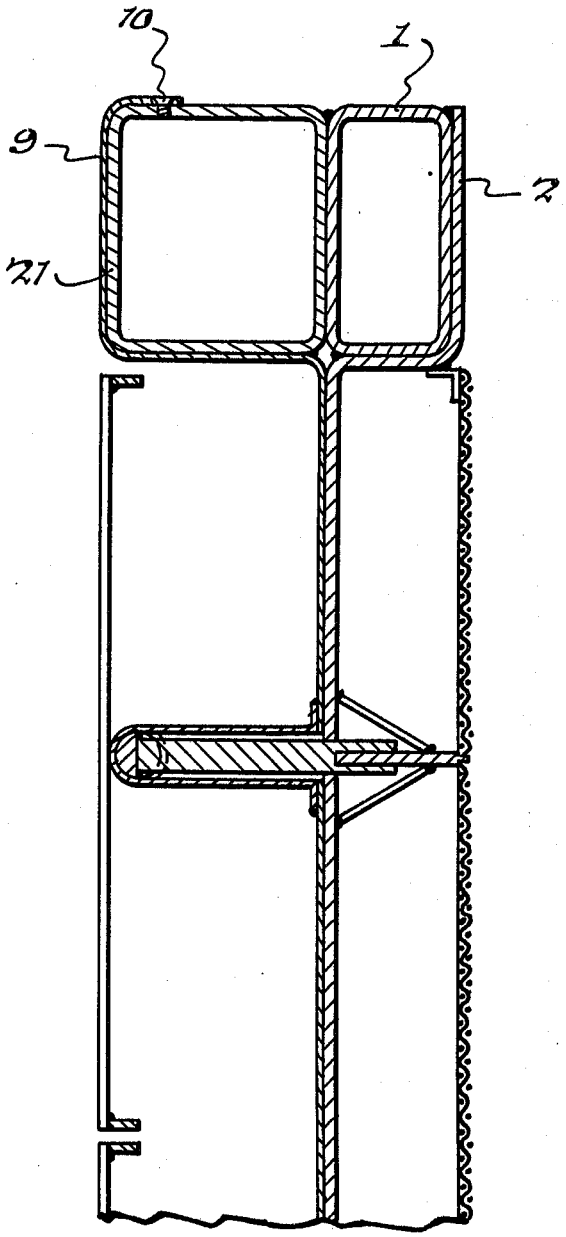
FIG. 6 is a partial sectional view of the electrode of FIG. 5, taken in the lower zone.

Bipolar Electrode With Incorporated Cathode And Anode Frames, And Attached Cathode And Anode Devesiculators or Degassers An electrode of this type is shown diagrammatically in FIGS. 5 and 6 of the present application.

In this example, the cathode and anode frames are both incorporated. The metal framework which results from the combining of them is formed in the case of the cathode frame of the mild steel tube 1 and the mild steel sheet 2 (as in Example 1), and in the case of the anode frame by the mild steel tube 21 and the titanium sheet 9 covering said rectangular tube 21 in order to protect it from the anolyte and fastened to it by screws 10.

The upper zones of the frames where the separation of the gases produced from the electrolyte takes place are attached to the metal framework. They may be of equal or unequal height, as shown in FIG. 5, depending on the gas-liquid separation of each compartment. The devesiculation or debubbling zone 22 of the cathode frame made of mild steel sheet communicates directly with the cathode compartment via orifices 23 provided in the upper portion of the frame. The devesiculation or defoaming zone 24 of the anode frame, made of thin titanium sheet, communicates with the anode compartment by titanium tubes 25 which protect the framework of mild steel.

The combining of the steel sheet 2 and of the titanium sheet 9 constitutes the bimetallic base plate of the electrode which serves as reference plane.

On this base plate, the anodically and cathodically active surfaces as well as the passages of the current between these two surfaces are developed in the same manner as in Example 1.

EXAMPLE 3

Figure 7:
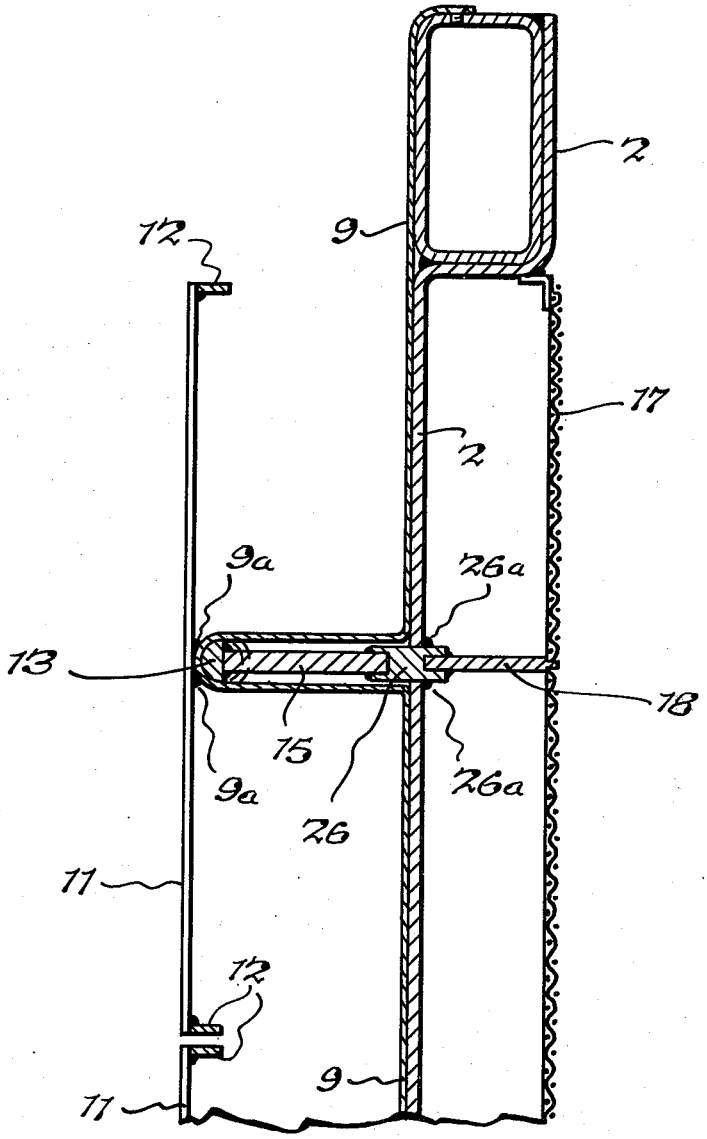
FIG. 7 is a horizontal section of another embodiment of an electrode of the invention.

In this example there is a bipolar electrode with incorporated cathode and/or anode frames and with cathode and/or anode devesiculators or defoamers attached (as in Example 2) or integrated (as in Example 1), with simplified current passages between anodically and cathodically active surfaces. As shown in FIG. 7, section in widthwise direction, describes a connecting part 26 of mild steel welded to the base sheet 2 which is also of mild steel, the welding 26*a* being effected on the cathode compartment side. In this same compartment there is welded to this connecting part the steel plate 18 which supports the cathode netting 17 and which distributes the current over the entire height of the electrode.

On the anode side, the assembly consisting of the co-extruded rod 13 and copper plate 15 is brazed on the connecting part 26. The titanium sheet 9 which is part of the bimetallic base plate also protects the copper plate 15 connecting by welding at 9*a* to the titanium of the co-extruded rod.

EXAMPLE 4

This example depicts a bipolar electrode with incorporated cathode and/or anode frames with cathode and/or anode devesiculators or defoamers attached (as in Example 2) or integrated (as in Example 1) with simplified current passages between anodically and cathodically active surfaces.

Figure 8:
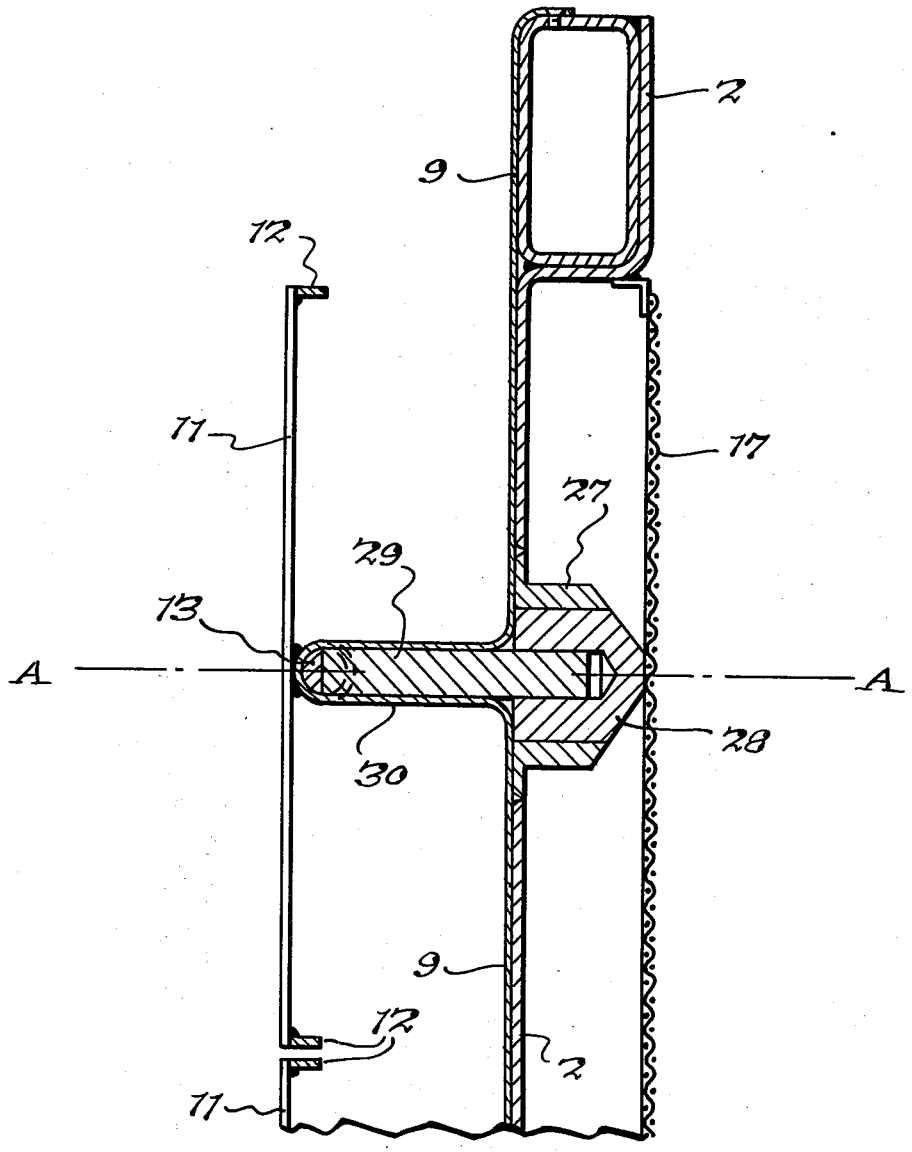
FIG. 8 is a horizontal section of another embodiment of an electrode of the invention.
Figure 9:
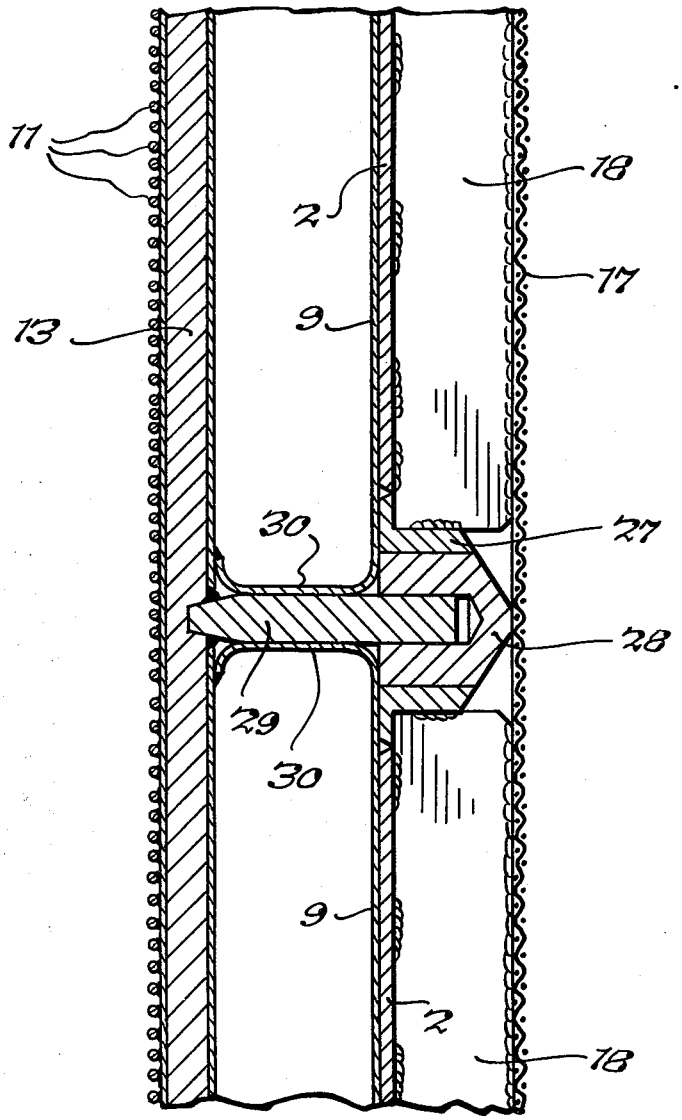
FIG. 9 is a section taken along the line A—A of FIG. 8.

FIGS. 8 (section in widthwise direction) and 9 (section in direction of the height) show the development of such an electrode.

A mild steel base 27 is welded to the mild steel sheet 2, an element of the bimetallic base plate.

The passage of the electrical current between the anodically active portion formed of titanium wires 11 welded on a copper-titanium co-extruded rod 13 and the cathodically active portion formed of a netting of mild steel 17 (as in Example 1) is effected by copper bar 29 which are protected by titanium sheathings 30.

The rings of mild steel 28 are mounted by clamping fit, by heating these rings, on copper bar 29. The final assembling is effected by welding the ring 28 to the base 27. This weld must be of excellent quality, since it permits the passage of the electrical current between the two portions of the bipolar electrode. The electrical current between the two portions passes from the titanium wires 11 to the co-extruded rod 13, to the copper bar 29 clamped while hot onto the rings 28 via the weld to the mild steel base 27. The steel plates 18 welded to the base 27 distribute the current to the steel cathode netting 17.

The terms and expressions which have been employed are used in terms of description and not of limitation, and there is no intention in the use of such terms and expressions of excluding any equivalents of the features shown and described or portions thereof, but it is recognized that various modifications are possible within the scope of the invention claimed.

What is claimed is:

1. A bipolar electrode for electrolysis cells of the filter-press type, said bipolar electrodes having cathode and anode frames and a bimetallic base plate characterized by the fact that the cathode and/or anode frames are integrated with the bimetallic base plate of said bipolar electrode, which base plate serves as a reference plane, the perpendicularity with respect to said plane being assured with respect to the cathode and anode portions by the current leads to which they are welded, said current leads serving as stiffeners and resulting in the planarity of these electrode portions of their parallelism with respect to the reference plane formed by the bimetallic base plate said current leads passing through said bimetallic base plate of said bipolar electrode to insure the positioning of the surface of said anode portion.

2. A bipolar electrode according to claim 1, characterized by the fact that the current leads acting as stiffeners comprise a copper current-passage part between the anodically active portion and the cathodically active portion, which part is connected directly to the said anodically active portion via at least one connecting part of steel serving to distribute the current to the cathode side.

3. A bipolar electrode according to claim 2, characterized by the fact that the current leads which act as stiffeners comprise a copper current-passage part brazed on the anode side onto a copper-titanium co-extruded rod, said current-passage part being protected on the anode side by sheathings of titanium and being connected on the cathode side by clamping fit by at least one ring of mild steel which is welded to a base which is rigidly connected with steel parts which distribute current to the cathodically active portion.

4. A bipolar electrode according to claim 1, characterized by the fact that the cathode surface is fastened on the one hand on the current leads and on the other hand on the cathode frame.

5. An electrode according to claim 1, characterized by the fact that the cathode surface is formed of perforated sheets or netting of iron.

6. A bipolar electrode according to claim 1, characterized by the fact that boxes are provided to assure the separation of gas and electrolyte and are integrated with the electrode.

7. A bipolar electrode according to claim 1, characterized by the fact that boxes are provided to assure the separation of gas and electrolyte and said boxes are attached to said electrode.

8. An electrode according to claim 1, characterized by the fact that the anode surface is formed of titanium wires covered with precious metal which are connected together at their ends.

* * * * *